US008561833B2

(12) United States Patent
Mallet

(10) Patent No.: US 8,561,833 B2
(45) Date of Patent: Oct. 22, 2013

(54) ALTERNATIVE FEEDING DEVICE FOR INFANTS AT RISK

(75) Inventor: Nadia Rodrigues Mallet, Rio de Janeiro (BR)

(73) Assignee: Fundacao Oswaldo Cruz, Rio de Janeiro (BR)

( * ) Notice: Subject to any disclaimer, the term of this patent is extended or adjusted under 35 U.S.C. 154(b) by 0 days.

(21) Appl. No.: 13/057,209

(22) PCT Filed: Aug. 3, 2009

(86) PCT No.: PCT/BR2009/000228
§ 371 (c)(1),
(2), (4) Date: May 3, 2011

(87) PCT Pub. No.: WO2010/015048
PCT Pub. Date: Feb. 11, 2010

(65) Prior Publication Data

US 2011/0220672 A1 Sep. 15, 2011

(30) Foreign Application Priority Data

Aug. 4, 2008 (BR) ..... 8801987 U

(51) Int. Cl.
*A47G 19/22* (2006.01)

(52) U.S. Cl.
USPC ..... 220/719

(58) Field of Classification Search
USPC ..... 73/426; 220/719, 703; 215/11.4, 11.1; 206/459.5, 459.1; 222/158
IPC ..... A47G 19/22
See application file for complete search history.

(56) References Cited

U.S. PATENT DOCUMENTS

| | | | | |
|---|---|---|---|---|
| 1,564,470 | A * | 12/1925 | Crimmel | 73/427 |
| 5,397,036 | A * | 3/1995 | Maiwald | 222/475 |
| 5,645,191 | A * | 7/1997 | Neville | 220/717 |
| 5,878,908 | A | 3/1999 | Foley | |
| 6,263,732 | B1 * | 7/2001 | Hoeting et al. | 73/427 |
| 6,742,668 | B1 * | 6/2004 | Perlman | 220/631 |
| 2005/0029297 | A1 * | 2/2005 | Hughes | 222/158 |
| 2008/0017540 | A1 * | 1/2008 | Sawhney et al. | 206/514 |

FOREIGN PATENT DOCUMENTS

| | | | |
|---|---|---|---|
| GB | 2187722 | A | 9/1987 |
| GB | 2327334 | A | 1/1999 |

OTHER PUBLICATIONS

International Search Report for PCT/BR2009/000228.

* cited by examiner

*Primary Examiner* — Robert J Hicks
(74) *Attorney, Agent, or Firm* — Caesar, Rivise, Bernstein, Cohen & Pokotilow, Ltd.

(57) ABSTRACT

A device particularly suitable for feeding premature newborns consists of a cup with a raised colored graded scale placed on the cup side for easy visualization, a flow reducer composed of folds, a round spout formed from the cup rim facilitating contact with the mouth of the baby, and a lid of the cup rim which fits using pressure to avoid food contamination.

11 Claims, 3 Drawing Sheets

ALTERNATIVE FEEDING DEVICE FOR INFANTS AT RISK

The present utility model refers to a device made for oral use, physiological and for phonotherapy as a facilitator of training oral functions, helping in the breast feeding, avoiding the prolonged use of gastric probes and their complications.

STATE OF THE ART

Maternal milk is the best food for the newborn and is the only feeding they need until 6 months old. However, not all newborns can suckle, especially those that are very small or very sick. Alternative methods such as feed probes, baby bottle, spoon and sippy cup are needed until they become sufficiently strong or are old enough to suck effectively. The sippy cup has been little mentioned in medical literature, even if it is one of the recommended methods in training manuals and handling of breast feeding.

However, the utensils which are used currently, as devices for the alternative feeding of babies at risk, do not follow any standard that regulates the specifications of these utensils, with safety and effectiveness, to favor the oral mechanism used by newborns.

In search of prior art concepts the document P19303673 was found (Sucking container using suction, in the name of Vicente Gomez Úbero), which refers to container with a round and transparent body (1), which allows the sucking of a baby by instinctive sip sucking by the child, who sucks with his or her mouth through a rubber spout (3) the heated or unheated liquid contained in the body (1), which is sucked by using a disposable straw (4) placed inside the body (1) the container stays at an angle of about 90° in relation to the mouth of the child, having a upper round convex rim (3-A) of spout (3), a millimeter opening (3-A1) for air to enter and vapor to escape, responsible for the equilibrium of atmospheric pressure inside the body (1).

Also the document MU8001177-2 (Conditioner with a flow director to administer feed to babies, in the name of Márcia Siqueira Damasceno (BR/MG), Fernanda de Souza Quintão), describes a device that unites the functions of a baby feeding conditioner and helps its safe application. The administrator consists of a container (1) on whose edge there is a flow directing funnel (5) and suction stimulator (6), having an internal wire thread provided arrester (2) and graded scale (4); and also a lid (8) having a wire thread section (10) to fit the container (1) and a flowing out area (11) for the contents to empty out when it is rotated through to the protrusion (9) to control the opening and aligned with the funnel (5).

However, these utensils make it difficult to see the volume of the contents going to the mouth of the baby, resulting in liquid loss, as well as to risk choking. Moreover, the external edge strip of the prior art concept devices is not compatible with the mouth anatomy of newborns and many times depending on the texture, run the risk of traumatizing the tongue and lips of the baby. Another disadvantage of the prior art concept devices is the liquid handling which favors contamination.

SUMMARY OF THE INVENTION

In accordance with the current utility model for the alternative feeding device of babies at risk, who need protection, provides an alternative oral feeding for premature and full term newborns and babies of other ages. The said device has other advantages, which are: the use of gastric probes for less time; better child safety and for whom administers the diet; eliciting early tongue reflexes helping the capacity to breast feed; comfort for the newborn because it respects its oral physiology; motivation for mothers as well as health professionals to offer feeding with the device, giving the chance for premature newborns to be fed; earlier discharge from hospital and exclusive feeding.

The device in accordance with the current utility model can be used in the Neonatal Intensive Care Units (NICU), with premature newborns who are already clinically stable, neurologically and motor control mature with a weight greater than or equal to 1,600 g; in the pediatric ward (newly born which need assistance) and cases of exclusively feeding children, at home, when the mother is not there so there isn't any problem with the spout.

Within the objectives of the present utility model request we can point out:

Breathing risk reduction for the premature new born during oral feeding with the device, bringing more safety for who is offering the feed.

Side effect reduction due to prolonged use of feeding tubes.

Oral function improved maturation.

Allows the avoidance of introducing other feeding methods which can cause spout problems resulting in a precocious weaning.

One of the biggest benefits of the device in question is avoiding skeletal deformities brought by the inadequate use of other types of feeding.

BRIEF DESCRIPTION OF THE DRAWINGS

To understand better present model device it is shown in the following described Figures.

DETAILED DESCRIPTION OF PREFERRED EMBODIMENTS

Figure 1:
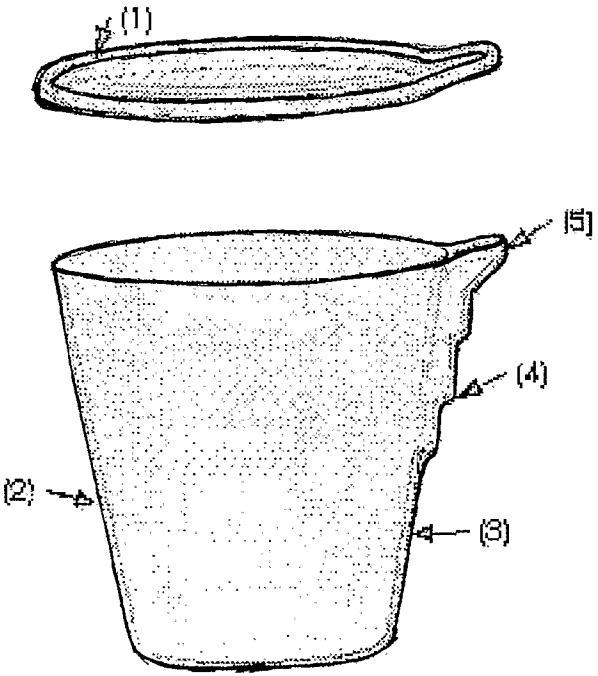
FIG. 1 is a side view of the present utility model device.
Figure 2:
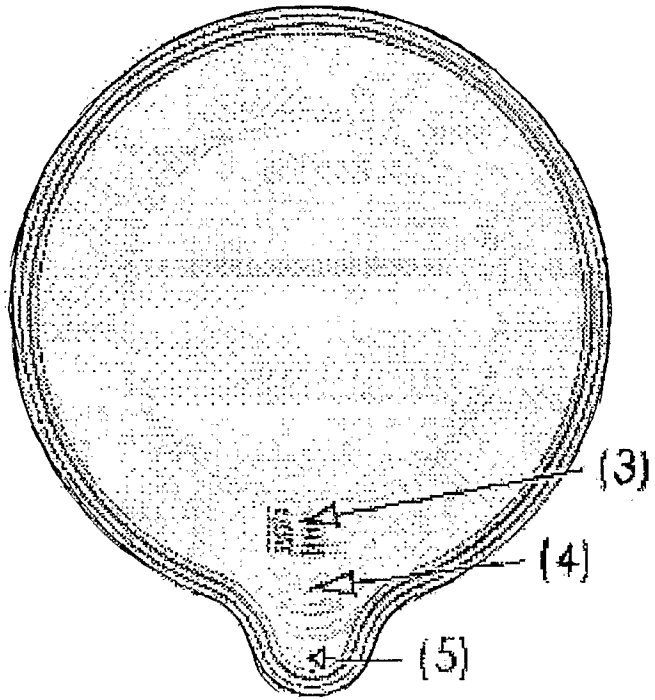
FIG. 2 is a top view of the present utility model device.
Figure 3:
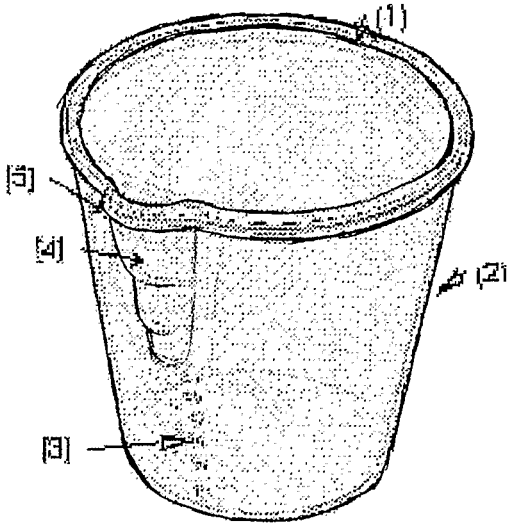
FIG. 3 is a perspective view (perspective 1) of the present utility model device.

As can be seen in the attached figures, the objective of the present patent is made up of a lid which follows the form of a rim where it fits by pressure (1), a plastic transparent cup with a conical form (2), a graded scale printed on the cup side (3), and above this scale, a flow reducer composed of 3 folds (4). The cup rim is completely rounded forming a round spout approximately 1 cm in radius for feeding the liquid dose through the mouth of the baby (5). The device external rim radius should be compatible with the mouth anatomy of the premature newborns. It is preferable that the transparent plastic cup (2) has a conical form and a height of about 7 cm.

The device in accordance with the present utility model request is made of anti-allergic, non toxic, soft and odorless material and does not deform due to continuous sterilizations.

The invention claimed is:

1. A feeding device for babies, said feeding device comprising:

a plastic cup;

a graded scale placed on a side of the cup;

a flow reducer composed of folds positioned above the graded scale;

a cup rim having a round dosage spout adapted to inhibit competition between side searching reflexes, which favors oral organization during sucking; and a lid which follows a form of the cup rim such that the lid fits the cup rim by pressure.

2. The feeding device of claim 1, wherein the folds of the flow reducer are positioned below the spout.

3. The feeding device of claim 2, wherein the plastic cup is transparent and has a conical form.

4. The feeding device of claim 3, wherein the flow reducer has three folds.

5. The feeding device of claim 4, wherein an uppermost fold closest to the spout protrudes beyond an intermediate fold next closest to the spout, and the intermediate fold protrudes beyond a bottommost fold furthest from the spout.

6. The feeding device of claim 1, wherein the round dosage spout has a radius of about 1 cm.

7. A feeding device for babies, said feeding device comprising:

a cup;

a graded scale placed on a side of the cup;

a flow reducer composed of folds positioned above the graded scale;

a cup rim having a round dosage spout having a radius of about 1 cm; and a removable lid.

8. The feeding device of claim 7, wherein the folds of the flow reducer are positioned below the spout.

9. The feeding device of claim 8, wherein the cup is conical.

10. The feeding device of claim 8, wherein the flow reducer has three folds.

11. The feeding device of claim 10, wherein an uppermost fold closest to the spout protrudes beyond an intermediate fold next closest to the spout, and the intermediate fold protrudes beyond a bottommost fold furthest from the spout.

* * * * *